US007403701B2

(12) United States Patent
Choi et al.

(10) Patent No.: US 7,403,701 B2
(45) Date of Patent: Jul. 22, 2008

(54) WATER HEATING APPARATUS USING ELECTRODES

(75) Inventors: Jay Ho Choi, Seoul (KR); Hyoung Jun Kim, Seoul (KR); Sung Il Park, Anyang-si (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 11/356,980

(22) Filed: Feb. 21, 2006

(65) Prior Publication Data

US 2006/0204231 A1 Sep. 14, 2006

(30) Foreign Application Priority Data

Feb. 21, 2005 (KR) ..... 10-2005-0014016

(51) Int. Cl.
*H05B 3/60* (2006.01)

(52) U.S. Cl. ..... 392/316; 392/311

(58) Field of Classification Search ..... 392/311, 392/316, 322, 331
See application file for complete search history.

(56) References Cited

U.S. PATENT DOCUMENTS 938,127 A * 10/1909 Denhard ..... 392/320
5,440,667 A * 8/1995 Simpson et al. ..... 392/314
7,171,111 B2 * 1/2007 Sheldon ..... 392/312
7,190,886 B2 * 3/2007 Dubicki et al. ..... 392/326

FOREIGN PATENT DOCUMENTS

KR 1998-026993 8/1998
KR 20-0215415 3/2001

OTHER PUBLICATIONS

Partial English Language Translation of KR 20-0215415.

* cited by examiner

*Primary Examiner*—Thor S Campbell
(74) *Attorney, Agent, or Firm*—Greenblum & Bernstein, P.L.C.

(57) ABSTRACT

A water heating apparatus using electrodes is provided. The water heating apparatus includes a heating tank in which electrolyte solution is stored and a plurality pairs of heating electrodes composed of positive electrodes and negative electrodes arranged in the heating tank at uniform intervals. Since the plurality of pairs of electrodes are arranged in the heating tank at uniform intervals, the heating operation can be always performed in a state where the electrolyte solution of no less than the minimum water level is stored regardless of the direction of the heating tank so that it is possible to heat water or to generate steam. Therefore, the water heating apparatus can be easily applied to a product that is inclined or upset and that is not in a specific direction.

18 Claims, 9 Drawing Sheets

WATER HEATING APPARATUS USING ELECTRODES

BACKGROUND OF THE INVENTION

1. Field of the Invention

The present invention relates to a water heating apparatus that can be used for a steam cleaner or an oven, and more particularly, to a water heating apparatus in which three or more electrodes are arranged in a tank so that water can be heated regardless of the direction of the tank.

2. Description of the Background Art

In a common steam cleaner, as illustrated in FIG. 1, a water tank 1 that is a space for storing water and a boiler 10 for heating the water supplied by the water tank 1 to generate steam are included in the main body of the cleaner.

Here, a pump 3 is provided between the water tank 1 and the boiler 10 to supply water. A valve for opening and closing a channel may be provided instead of or in addition to the pump 3.

In the cleaner, a steam nozzle 7 for spraying the steam generated by the boiler 10 to an object to be cleaned is included in a head (not shown) that contacts the object to be cleaned.

A heating apparatus such as the boiler 10 that generates steam is used for the steam cleaner of the above structure or an oven for cooking. FIG. 2 is a perspective view illustrating a water heating apparatus that generates steam using carbon electrodes.

As illustrated in FIG. 2, a water heating apparatus 10' using carbon electrodes is divided into a heating tank 11 and carbon electrodes 15.

The heating tank 11 includes a water supply hole 12 for supplying electrolyte solution and a steam discharge hole 13 for discharging steam. The two or more carbon electrodes 15 are mounted on the bottom of the heating tank 11 so that current is flown to the carbon electrodes 15 to heat the electrolyte solution in the heating tank 11. Here, salt water that can be easily supplied can be used as the electrolyte solution and a carbon material having low reactivity is mainly used as the carbon electrodes 15.

In the water heating apparatus 10' using the carbon electrodes having the above structure, when current flows through the carbon electrodes 15 in a state where the pair of carbon electrodes 15 composed of a positive electrode and a negative electrode are sunken under the electrolyte solution in the heating tank 11 as illustrated in FIG. 3, the current that flows through the carbon electrodes 15 heats the electrolyte solution to generate steam.

However, when any one of the pair of carbon electrodes 15 is not sunken under the electrolyte solution, current does not flow through the carbon electrodes 15 so that a normal heating operation is not performed.

That is, since the pair of electrodes are provided on the bottom of the heating tank, when the heating tank is inclined at no less than a certain angle or is upset as illustrated in FIGS. 4 and 5, any of the pair of carbon electrodes 15 is not sunken under the electrolyte solution so that current does not flow through the carbon electrodes 15 and that the operation of the heating apparatus stops. Therefore, when the conventional water heating apparatus using the carbon electrodes is applied to an apparatus that severely vibrates or an apparatus that is not in a specific direction, the operation of the heating apparatus may not be normally performed so that there are limitations on applying the product.

SUMMARY OF THE INVENTION

Accordingly, an object of the present invention is to solve at least the problems and disadvantages of the background art.

It is an object of the present invention to provide a water heating apparatus using electrodes capable of always performing a normal heating operation in a state where electrolyte solution is filled in a heating tank to a certain amount even if the heating tank is inclined or upset so that it is possible to heat water or generate steam regardless of the direction of a product to which the water heating apparatus is to be applied.

In order to achieve the above object, there is provided a water heating apparatus using electrodes comprising a heating tank in which electrolyte solution is stored and a plurality pairs of heating electrodes composed of positive electrodes and negative electrodes arranged in the heating tank at uniform intervals.

The heating electrodes are arranged such that the positive electrodes and the negative electrodes alternate each other along the inner circumference of the heating tank.

The positive electrodes and the negative electrodes are arranged at uniform intervals.

The heating tank comprises a container and a top surface and a bottom surface that form both sides of the container so that a supply hole is formed on one side of the top surface and the bottom surface and that a discharge hole is formed on the other side.

The container is cylindrical.

The supply hole and the discharge hole face each other.

The heating electrodes are longitudinally arranged between the top surface and the bottom surface.

The heating electrodes are cylindrical.

In order to achieve the above object, there is provided a water heating apparatus using electrodes comprising a heating tank in which a supply hole through which electrolyte solution is supplied is formed on one side of a top surface and a bottom surface of a container and a discharge hole through which the electrolyte solution is discharged is formed on the other side and a plurality of pairs of heating electrodes composed of positive electrodes and negative electrodes that alternate each other along the inner circumference of the heating tank.

The container is cylindrical.

The positive electrodes and the negative electrodes alternate each other at uniform intervals.

The heating electrodes are longitudinally arranged between the top surface and the bottom surface.

The heating electrodes are cylindrical.

In order to achieve the above object, there is provided a water heating apparatus using electrodes comprising a heating tank in which electrolyte solution is stored and a plurality of pairs of heating electrodes composed of positive electrodes and negative electrodes arranged in the heating tank. The heating electrodes are arranged so that at least a part of at least a pair of electrodes is always sunken under the electrolyte solution in a state where the electrolyte solution of no less than a minimum water level is stored regardless of the direction or position of the heating tank.

The heating electrodes are arranged such that the positive electrodes and the negative electrodes alternate each other along the inner circumference of the heating tank at uniform intervals.

The heating tank comprises a container and a top surface and a bottom surface that form both sides of the container so that a supply hole is formed on one side of the top surface and the bottom surface and that a discharge hole is formed on the other side.

The container is cylindrical.

The supply hole and the discharge hole face each other.

The heating electrodes are longitudinally arranged between the top surface and the bottom surface.

The heating electrodes are cylindrical.

In the water heating apparatus using the electrodes according to the present invention having the above structure, since the plurality of pairs of electrodes are arranged in the tank at uniform intervals, the heating operation can be always performed in a state where the electrolyte solution of no less than the minimum water level is stored regardless of the direction of the tank so that it is possible to heat water or to generate steam. Therefore, the water heating apparatus can be easily applied to a product that is inclined or upset and that is not in a specific direction.

BRIEF DESCRIPTION OF THE DRAWINGS

The present invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
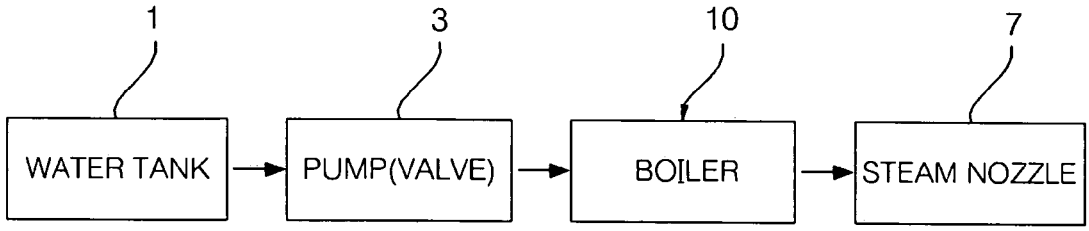
Fig. 1(related art)
FIG. 1 is a block diagram of a main part of a steam cleaner including a conventional water heating apparatus.
Figure 2:
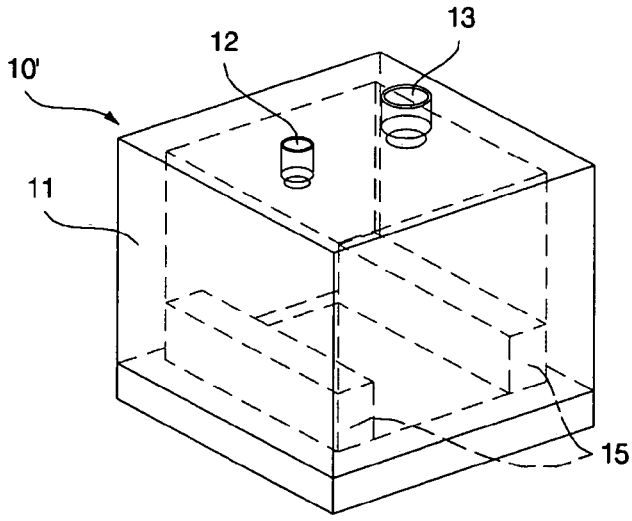
Fig. 2(related art)
FIG. 2 is a perspective view illustrating the conventional water heating apparatus.
Figure 3:
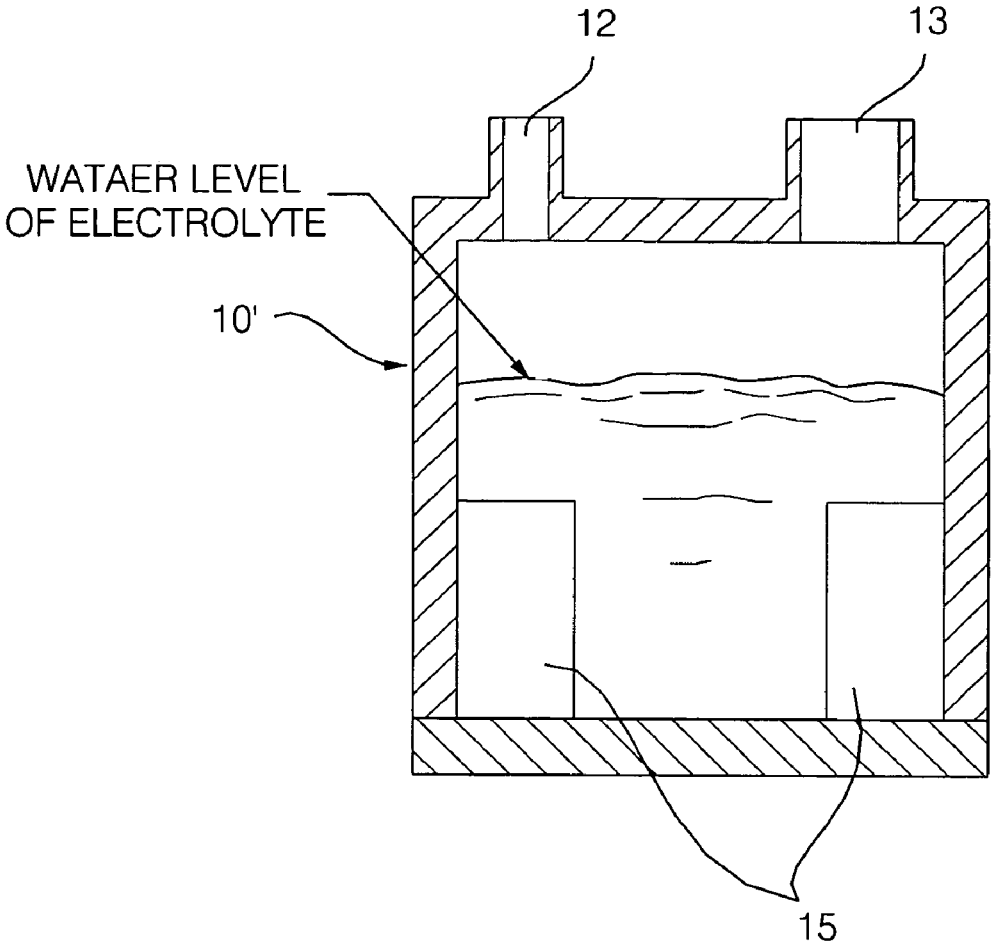
Fig. 3(related art)
FIG. 3 is a front-sectional view illustrating the conventional water heating apparatus.
Figure 4:
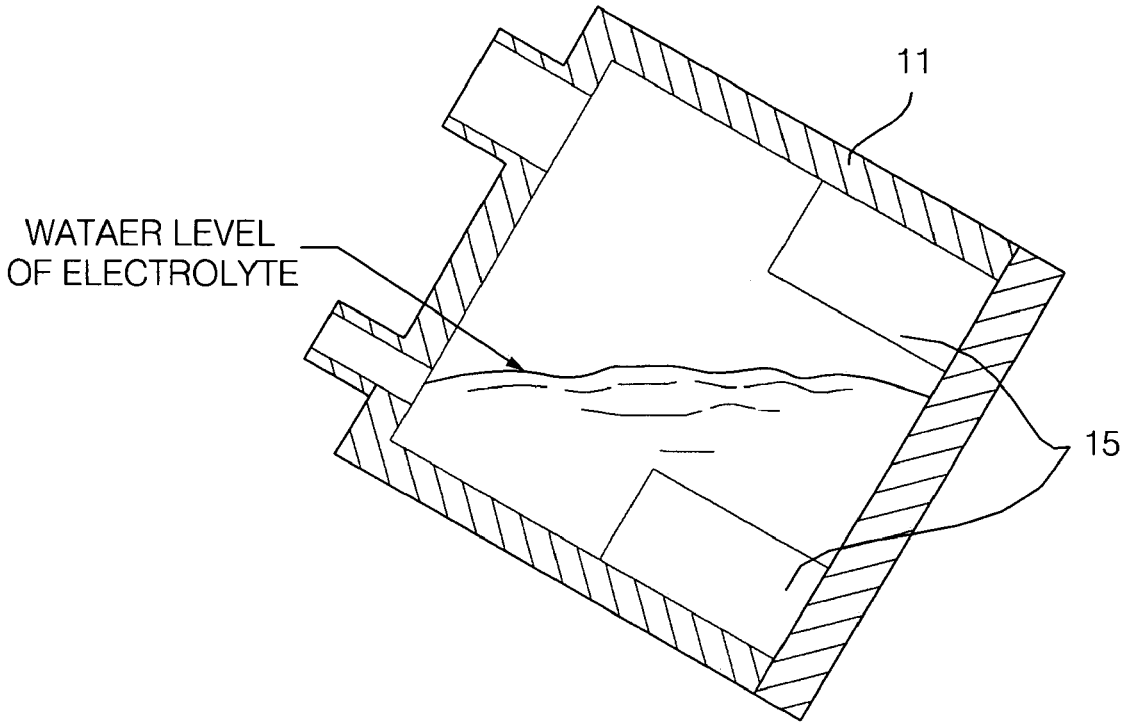
Fig. 4(related art)
FIGS. 4 to 6 illustrate states in which an electrode is sunken under electrolyte solution in accordance with change in position of the conventional water heating apparatus.
Figure 5:
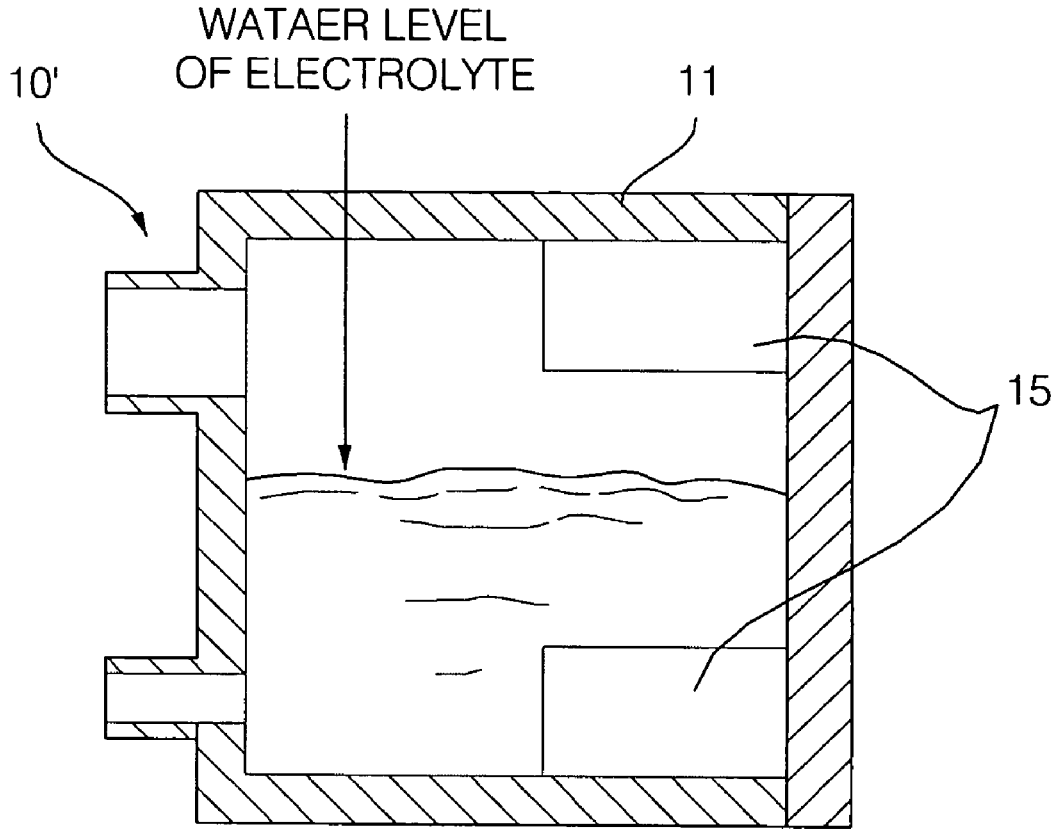
Fig. 5(related art)
Figure 6:
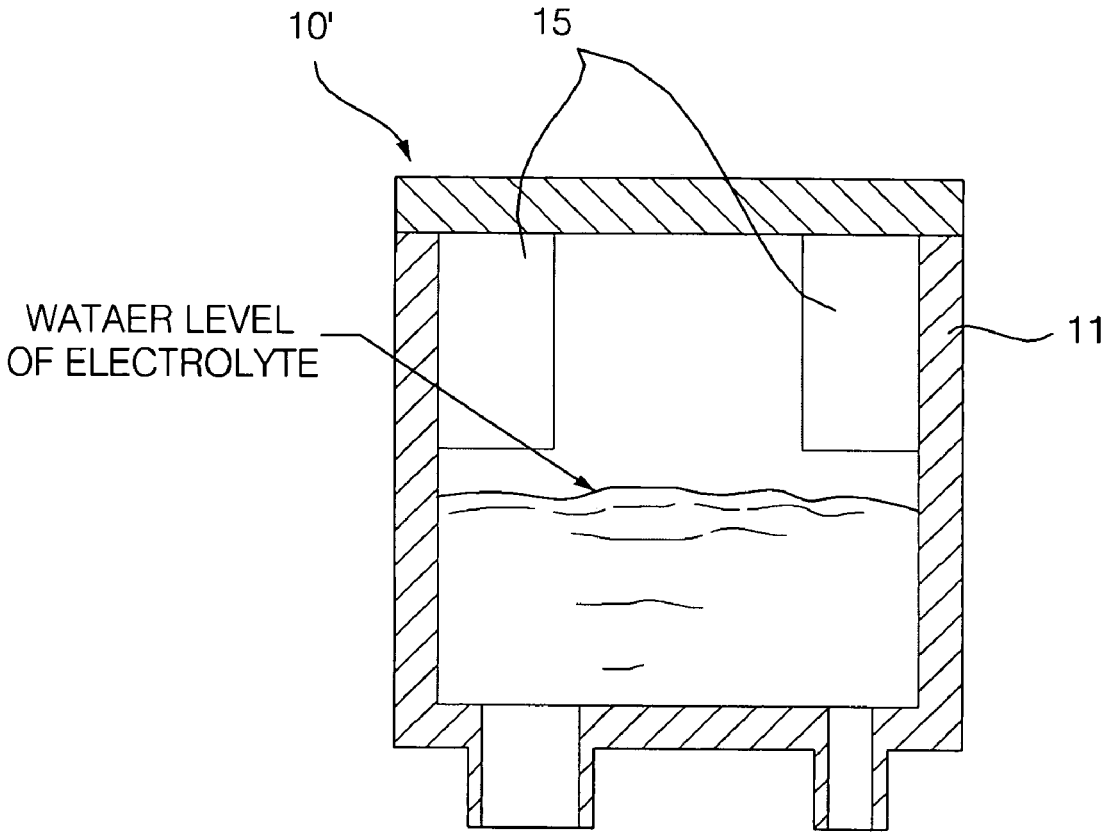
Fig. 6(related art)
Figure 7:
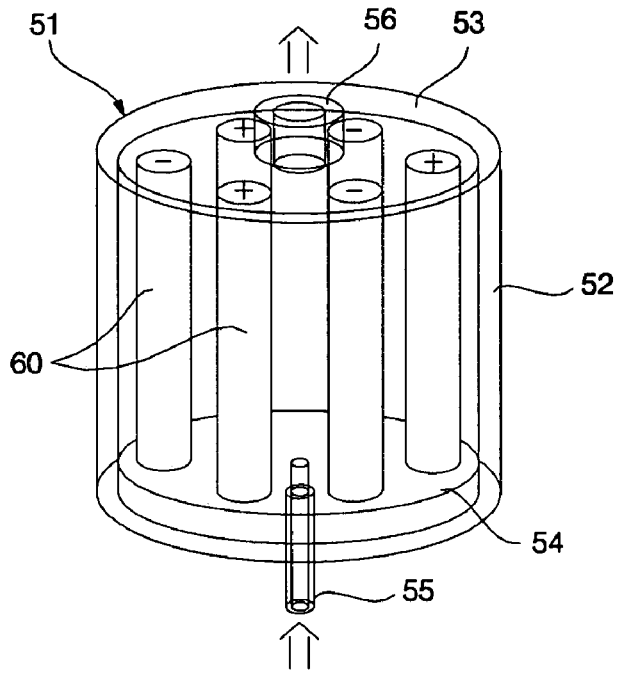
FIG. 7 is a perspective view illustrating a water heating apparatus according to the present invention.
Figure 8:
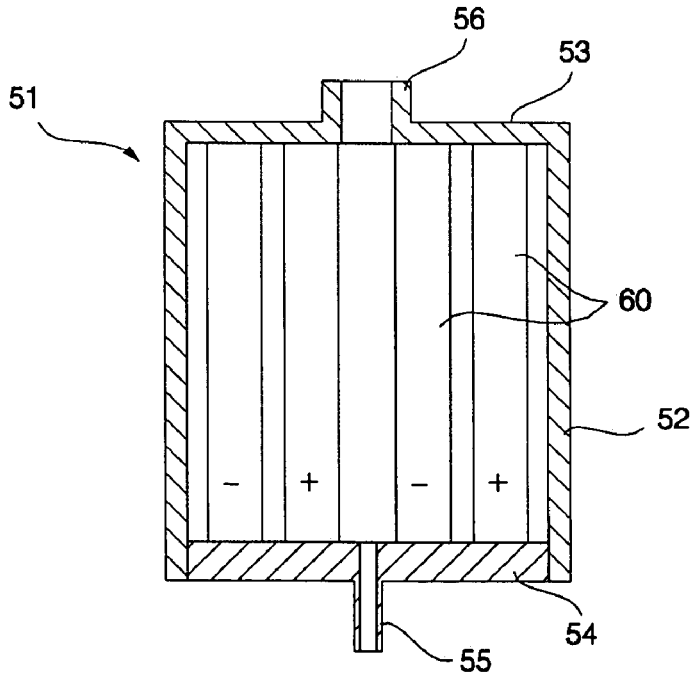
FIG. 8 is a front-sectional view illustrating the water heating apparatus according to the present invention.
Figure 9:
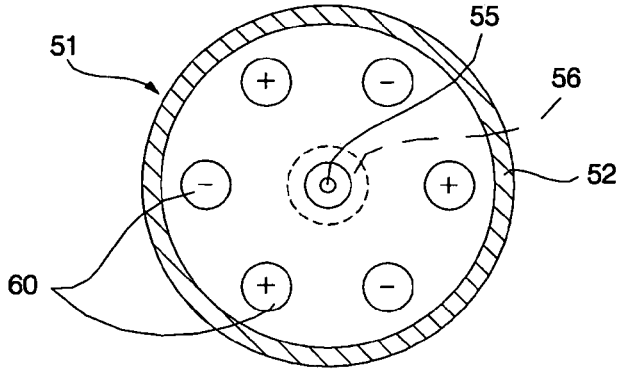
FIG. 9 is a plan-sectional view illustrating the water heating apparatus according to the present invention.

FIG. 7 is a perspective view illustrating a water heating apparatus according to the present invention. FIG. 8 is a front sectional view illustrating the water heating apparatus according to the present invention. FIG. 9 is a plan sectional view illustrating the water heating apparatus according to the present invention.

As illustrated in FIG. 7, a water heating apparatus using electrodes according to the present invention includes a heating tank 51 in which electrolyte solution is stored and heating electrodes 60 composed of a plurality of pairs of positive electrodes and negative electrodes that are uniformly arranged in the heating tank 51.

Here, the heating electrodes 60 are arranged so that at least a part of at least a pair of electrodes is always sunken under the electrolyte solution in a state where the electrolyte solution of no less than a minimum water level is stored regardless of the direction or position of the heating tank 51 and that the water stored in the heating tank 51 is always heated.

In the water heating apparatus, the heating tank 51 includes a container 52 and a top surface 53 and a bottom surface 54 that form both sides of the container 52. A supply hole 55 in which water is received and a discharge hole 56 to which steam is discharged are formed in the top surface 53 and the bottom surface 54.

The container 52 is cylindrical.

The supply hole 55 and the discharge hole 56 are formed to face each other.

Here, the heating tank 51 may be a polygonal pillar such as a square pillar and a pentagonal pillar as well as a cylinder. Also, the positions of the supply hole 55 and the discharge hole 56 may vary.

The heating electrodes 60 are arranged such that the positive electrodes and the negative electrodes alternate each other along the inner circumference of the heating tank 51 at uniform intervals so that current flows through at least a pair of electrodes in a state where the electrolyte solution of no less than the minimum water level is storated.

That is, when the heating tank 51 is cylindrical, the heating electrodes 60 are longitudinally arranged between the top surface 53 and the bottom surface 54 on the circumference of the heating tank 51 at uniform intervals.

Here, according to the present embodiment, three pairs of, that is, six electrodes are provided. However, the present invention is not limited to the above but less than or more than three pairs of electrodes may be provided.

At this time, the larger the number of pairs of electrodes of the heating electrodes 60 is, the smaller the minimum water level of the heating tank 51 is.

The heating electrodes 60 are preferably formed of carbon electrodes. The heating electrodes 60 may be formed of cylinders as illustrated in the drawings or may be formed of polygonal pillars such as rectangular pillars although not shown in the drawings. The operation of the water heating apparatus using the electrodes according to the present invention having the above structure will be described as follows.

Figure 10:
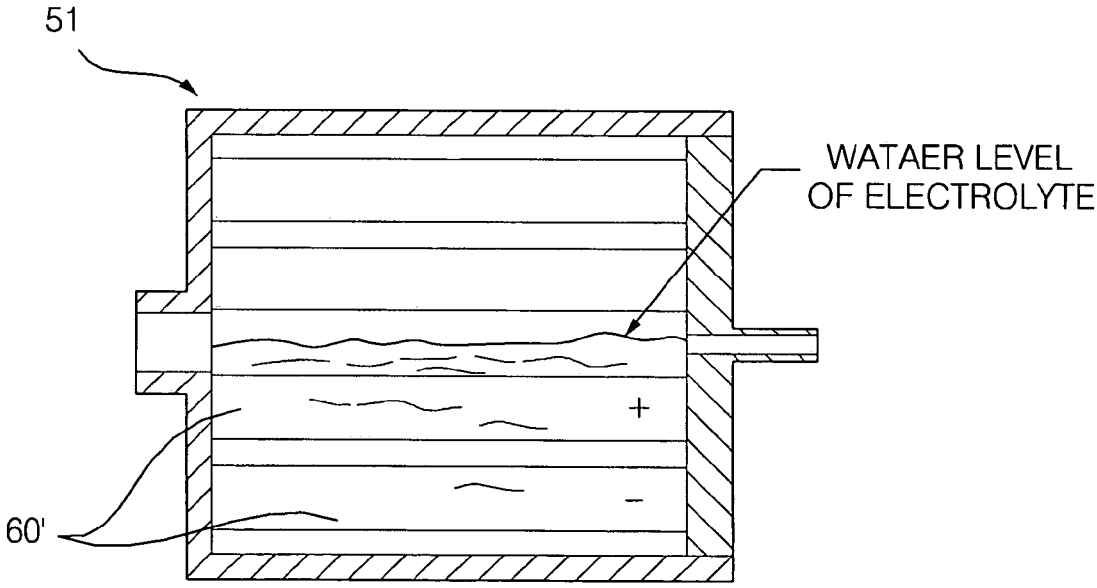
FIGS. 10 and 11 illustrate states in which electrodes are sunken under electrolyte solution when the water heating apparatus according to the present invention is in a horizontal direction.
Figure 11:
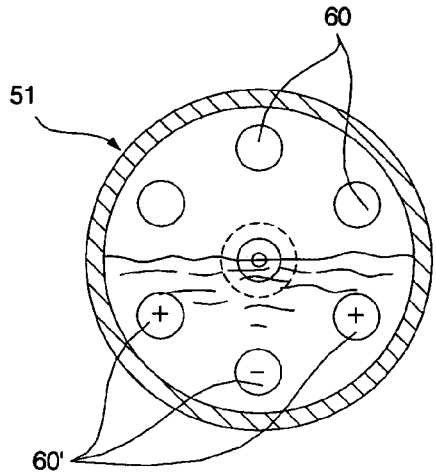
Figure 12:
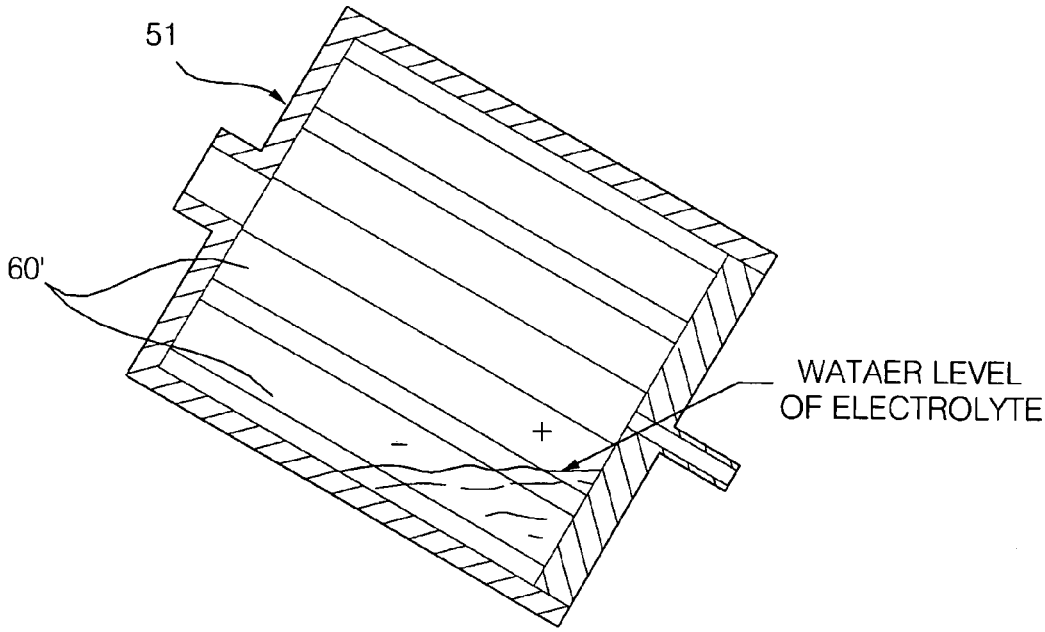
FIGS. 12 and 13 illustrate states in which the electrodes are sunken under the electrolyte solution when the water heating apparatus according to the present invention is inclined at a certain angle.
Figure 13:
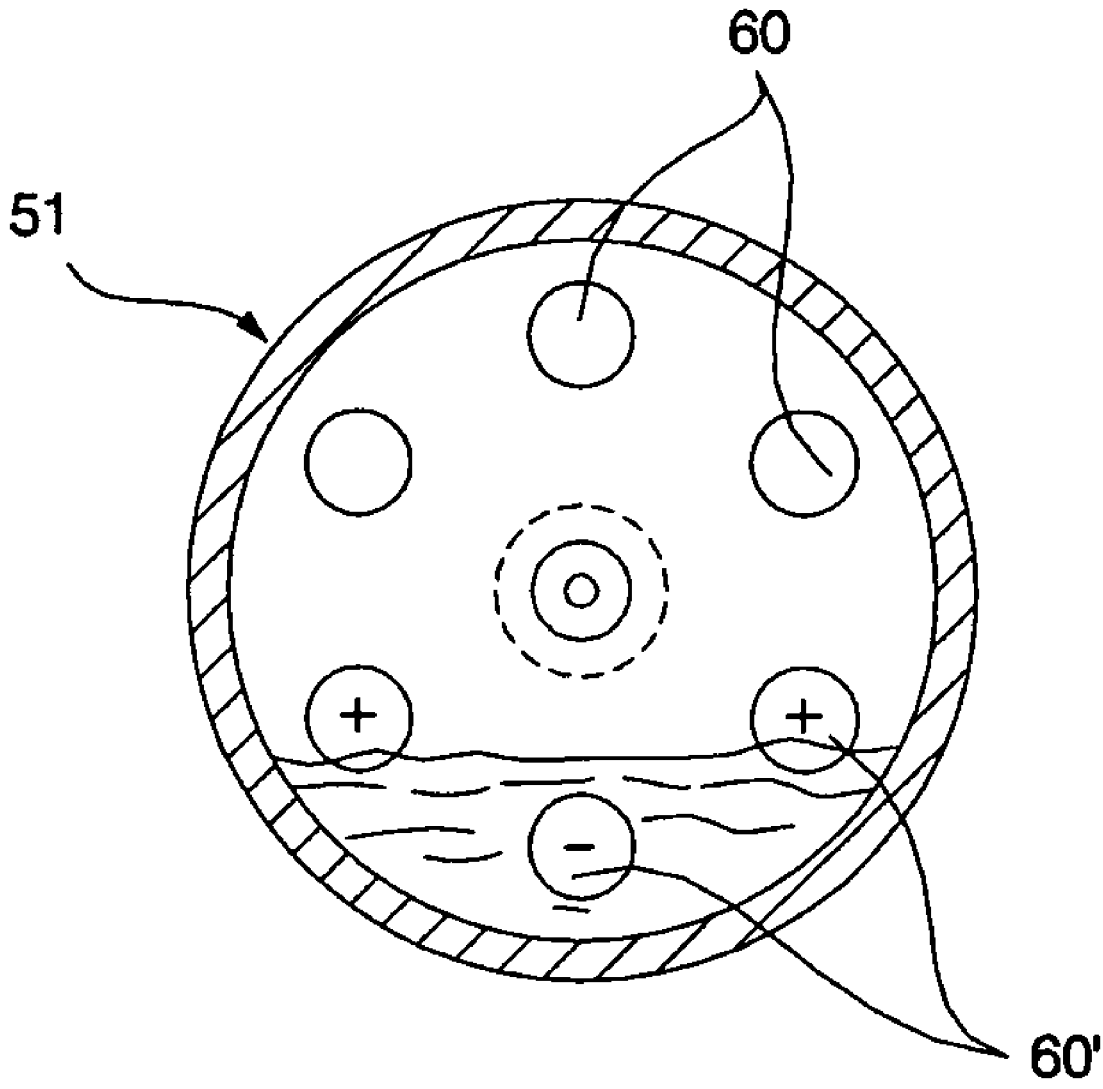

FIGS. 10 and 11 illustrate states in which the electrodes are sunken under the electrolyte solution when the water heating apparatus according to the present invention is in a horizontal direction. FIGS. 12 and 13 illustrate states in which the electrodes are sunken in the electrolyte solution when the water heating apparatus according to the present invention is inclined at a certain angle.

When the heating tank 51 is in the horizontal direction so that the electrolyte solution fills about half of the heating tank 51 as illustrated in FIG. 11, three 60' of the heating electrodes 60 including two positive electrodes and one negative electrode are sunken under the electrolyte solution. When electricity is applied to the heating electrodes 60 in such a state, current flows through the heating electrodes 60' sunken under the electrolyte solution to heat the electrolyte solution.

FIGS. 10 and 11 illustrate the states in which all of the three 60' of the heating electrodes 60 are sunken under the electrolyte solution. However, FIGS. 12 and 13 illustrate the states in which only parts of the three 60' of the heating electrodes 60 are sunken under the electrolyte solution.

That is, when the heating tank 51 is inclined at a certain angle with respect to the perpendicular direction, only the lower parts of the three electrodes 60' are sunken under the electrolyte solution. At this time, when even parts of the positive electrodes and negative electrodes are sunken under the electrolyte solution, current flows through the electrolyte solution to heat the electrolyte solution.

Here, when the water level of the electrolyte solution filled in the heating tank 51 becomes lower so that only one electrode is sunken under the electrolyte solution, current does not flow. Therefore, the minimum water level is preferably determined in accordance with the direction of the heating tank 51. In order to reduce the minimum water level, more heating electrodes 60 must be arranged in the heating tank 51.

The effects of the water heating apparatus using the electrodes according to the present invention having the above structure will be described as follows.

In the water heating apparatus using the electrodes according to the present invention having the above structure, since not only a pair of electrodes but a plurality of pairs of electrodes are arranged in the heating tank at uniform intervals unlike in the conventional water heating apparatus, the heating operation can be always performed in a state where the electrolyte solution of no less than the minimum water level is stored regardless of the direction of the heating tank so that it is possible to heat water or to generate steam. Therefore, the water heating apparatus according to the present invention can be easily applied to a product that is inclined or upset and that is not in a specific direction.

What is claimed is:

1. A water heating apparatus using electrodes comprising:

a heating tank in which electrolyte solution is stored; and a plurality pairs of heating electrodes composed of positive electrodes and negative electrodes arranged in the heating tank at uniform intervals, wherein the heating tank includes a bottom surface and a top surface, the bottom surface having a supply hole through which water is supplied, and the top surface having a discharge hole through which steam is discharged, and wherein a diameter of the discharge hole is greater than a diameter of the supply hole.

2. The water heating apparatus as claimed in claim 1, wherein the heating electrodes are arranged such that the positive electrodes and the negative electrodes alternate with each other along an inner circumference of the heating tank.

3. The water heating apparatus as claimed in claim 2, wherein the positive electrodes and the negative electrodes are arranged at uniform intervals.

4. The water heating apparatus as claimed in claim 1, wherein the container is cylindrical.

5. The water heating apparatus as claimed in claim 1, wherein the supply hole and the discharge hole face each other.

6. The water heating apparatus as claimed in claim 1, wherein the heating electrodes are longitudinally arranged between the top surface and the bottom surface.

7. The water heating apparatus as claimed in claim 1, wherein the heating electrodes are cylindrical.

8. A water heating apparatus using electrodes comprising:

a heating tank in which a supply hole through which electrolyte solution is supplied is formed on one side of a top surface and a bottom surface of a container and a discharge hole through which the electrolyte solution is discharged is formed on the other side; and a plurality of pairs of heating electrodes composed of positive electrodes and negative electrodes that alternate with each other along an inner circumference of the heating tank, wherein the heating tank includes a bottom surface and a top surface, the bottom surface having a supply hole through which water is supplied, and the top surface having a discharge hole through which steam is discharged, and wherein a diameter of the discharge hole is greater than a diameter of the supply hole.

9. The water heating apparatus as claimed in claim 8, wherein the container is cylindrical.

10. The water heating apparatus as claimed in claim 8, wherein the positive electrodes and the negative electrodes alternate with each other at uniform intervals.

11. The water heating apparatus as claimed in claim 8, wherein the heating electrodes are longitudinally arranged between the top surface and the bottom surface.

12. The water heating apparatus as claimed in claim 8, wherein the heating electrodes are cylindrical.

13. A water heating apparatus using electrodes comprising:

a heating tank in which electrolyte solution is stored; and a plurality of pairs of heating electrodes composed of positive electrodes and negative electrodes arranged in the heating tank, wherein the heating electrodes are arranged so that at least a part of at least a pair of electrodes is always sunken under the electrolyte solution in a state where the electrolyte solution of no less than a minimum water level is stored regardless of the direction or position of the heating tank, wherein the heating tank includes a bottom surface and a top surface, the bottom surface having a supply hole through which water is supplied, and the top surface having a discharge hole through which steam is discharged, and wherein a diameter of the discharge hole is greater than a diameter of the supply hole.

14. The water heating apparatus as claimed in claim 13, wherein the heating electrodes are arranged such that the positive electrodes and the negative electrodes alternate with each other along the inner circumference of the heating tank at uniform intervals.

15. The water heating apparatus as claimed in claim 13, wherein the container is cylindrical.

16. The water heating apparatus as claimed in claim 13, wherein the supply hole and the discharge hole face each other.

17. The water heating apparatus as claimed in claim 13, wherein the heating electrodes are longitudinally arranged between the top surface and the bottom surface.

18. The water heating apparatus as claimed in claim 13, wherein the heating electrodes are cylindrical.

* * * * *